United States Patent [19]

Craven

[11] 4,156,128

[45] May 22, 1979

[54] ELECTRICAL HEATER

[75] Inventor: John L. Craven, Essex, England

[73] Assignee: Liquifry Company Limited, Surrey, England

[21] Appl. No.: 887,845

[22] Filed: Mar. 17, 1978

[30] Foreign Application Priority Data

Mar. 18, 1977 [GB] United Kingdom ..... 11687/77

[51] Int. Cl.[2] ..... H05B 3/80; H01C 1/02

[52] U.S. Cl. ..... 219/523; 219/331; 219/335; 219/534; 219/544; 338/229; 338/302

[58] Field of Search ..... 219/316, 318, 328, 331, 219/332, 335, 512, 523, 530, 534, 542, 544; 338/229, 302

[56] References Cited

U.S. PATENT DOCUMENTS

| | | | |
|---|---|---|---|
| 2,766,367 | 10/1956 | Chaustowich | 219/523 |
| 3,107,290 | 10/1963 | Willinger | 219/523 X |
| 3,329,803 | 7/1967 | Sink | 219/523 X |
| 3,340,382 | 9/1967 | Lennox | 219/544 |
| 3,371,192 | 2/1968 | Rosener | 219/523 |
| 3,616,565 | 11/1971 | D'Elira et al. | 219/523 |
| 3,731,058 | 5/1973 | Bleiweiss | 219/523 |
| 3,895,217 | 7/1975 | Hall et al. | 219/523 |
| 4,072,847 | 2/1978 | Craven | 219/523 |

FOREIGN PATENT DOCUMENTS

| | | | |
|---|---|---|---|
| 595969 | 12/1947 | United Kingdom | 219/523 |
| 1197330 | 7/1970 | United Kingdom | 219/523 |
| 1373093 | 11/1974 | United Kingdom | 219/523 |

*Primary Examiner*—Volodymyr Y. Mayewsky
*Attorney, Agent, or Firm*—Browdy and Neimark

[57] ABSTRACT

An electrical heater is combined with a thermostat in a sealed enclosure itself sealed in a glass tube, the enclosure comprising two tubes telescoped together, one being translucent and containing the thermostat and the other being of electrically insulating material, e.g. ceramic.

10 Claims, 2 Drawing Figures

ELECTRICAL HEATER

BACKGROUND OF THE INVENTION

The present invention relates to an electrical heater having a heating element combined with a temperature-sensitive device for controlling the operating temperature of the element as a function of ambient temperature.

U.S. Pat. No. 4,072,847 discloses such a heater which comprises a glass tube within which is sealed a tubular enclosure comprising a first tube closed at one end and a second tube joined in water-tight fashion to the other end of the first tube. A heating element is within the first tube and a thermostat for the heating element is within the second tube. The first tube is of metal and the second of translucent or transparent plastic, and, in order to meet British Standards No. 3456, the heating element is separated from the metal tube by a tube of insulating material. However, it has now been realized that the tube of insulating material and the air trapped between it and the metal tube considerably reduces the heat transfer from the heating element. It is an object of the invention to improve the heat transfer.

SUMMARY OF THE INVENTION

According to the present invention there is provided an electrical heater for heating a liquid, the heater having an electrical heating element, a temperature-sensitive device for controlling the operating temperature of the element as a function of ambient temperature, and a tubular enclosure sealed against ingress of moisture and formed by a first tube closed at one end and an electrically insulating second tube joined in water-tight manner to the other end of the first tube, the heating element being within the first tube and the temperature-sensitive device being within the second tube, the second tube being of electrically insulating translucent material and the first tube being electrically insulating, water-impermeable, capable of withstanding the heat transmitted through it from the heating element and capable of withstanding an impact with an energy of 0.5 Nm applied by a hammer having a tip of 10 mm radius. The first tube can be of ceramic material, such as a porcelain, preferably an aluminous porcelain, and the second tube can be of plastic material.

BRIEF DESCRIPTION OF THE DRAWINGS

For a better understanding of the invention and to show how the same may be carried into effect, reference will now be made by way of example to the accompanying drawings, in which.

DESCRIPTION OF PREFERRED EMBODIMENTS

Figure 1:
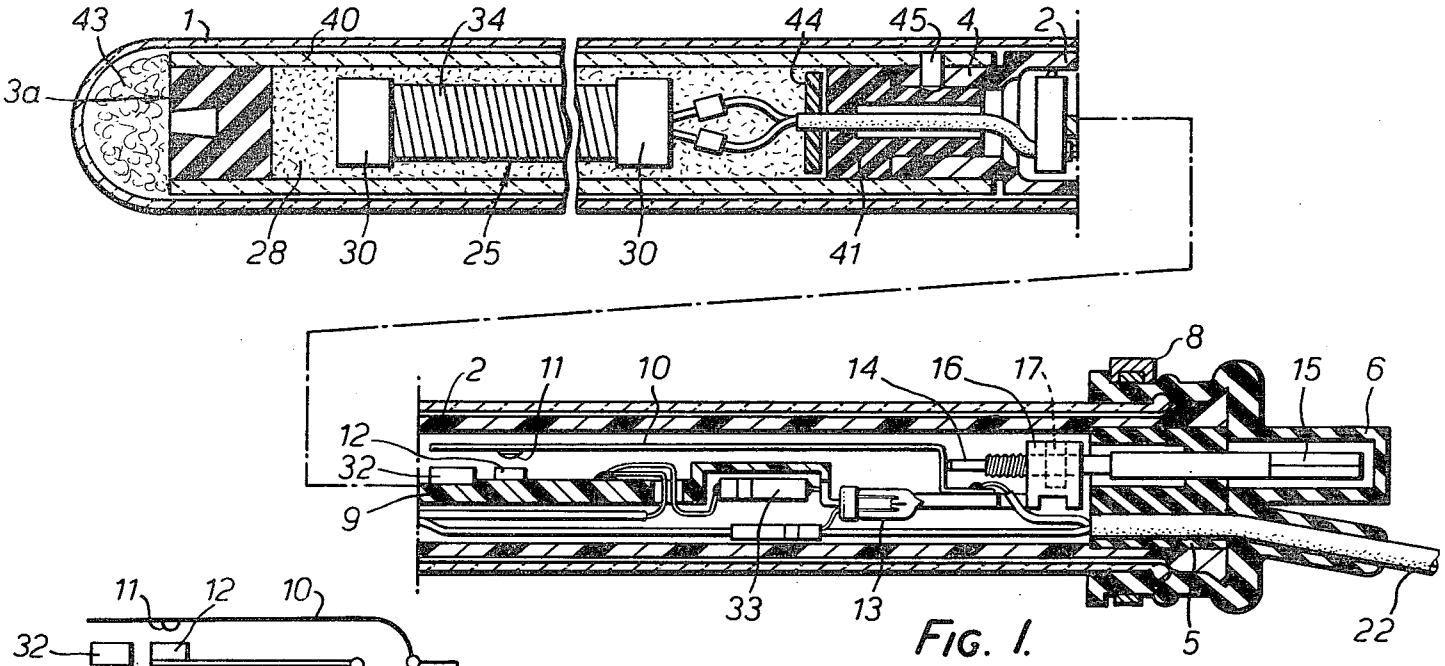
FIG. 1 is a cross-sectional view of an embodiment of the water heater.

The heater of FIG. 1 uses the same numerals as in U.S. Pat. No. 4,072,847 for like parts. It comprises a heating element 25 having a heater conductor 34 wound on a former. On the ends of the former are wound turns of glass fiber tape 30 to maintain the conductor 34 spaced from the surrounding tubes. The element 25 is sealed within a compartment defined by an aluminous porcelain tube 40 (16.5 mm O/D and 12.5 mm I/D) sealed by a synthetic rubber bung 3*a* at one end and a semi-flexible synthetic rubber bung 41 at the other end.

The synthetic rubber can be silicone or nitrile rubber. The compartment can if desired be filled with mineral insulation 28 (Maglox). A sealing washer 44, to prevent the insulation 28 escaping, is fixed to the inner end of the bung 41. The ceramic tube 40 is telescoped onto a reduced diameter portion 4 of a plastic, transparent or semi-transparent (translucent), tube 2 defining with the bung 41 and a further bung 5 a second compartment in which is sealed a thermostat mounted on a support 9. The tube 2 may be of polycarbonate or acrylic plastic material. Surrounding the ceramic and plastics tubes is a glass tube 1 in which the heater is sealed by means of a cover or cap 6 which has a projection enabling an adjusting member 15 for the thermostat to be manually rotated. There is a small air gap between tube 1 and tubes 40 and 2.

The heater illustrated in FIG. 1 has been designed to meet the requirements of British Standards No. 3456 with respect to domestic water heaters, such as aquarium heaters. In particular, the arrangement providss the necessary degree of strength and also electrical insulation, providing so-called double insulation. In particular, the hammer test is met, using a hammer with a 10 mm radius tip delivering an impact pressure of 0.5 Nm. This breaks the glass tube 1 but does not significantly damage the tubes 40 and 2.

Moreover, the tubes 2 and 40 are interlocked by a press-fit plastic pin 45 engaging in holes in both tubes. This pin can be drilled out if it is necessary to dismantle the heater but complies with the present safety regulations which specify that the heater should be incapable of being taken apart without the use of a tool. This regulation applies also to a securing band 8 which secures cover 6 to the glass tube, the band 8 being, for example, either secured by a screw or by an integral ratchet which opposes loosening of the band.

A wad of mineral wool filling 43 or a hemispherical rubber bung may fill the space between the end of the glass tube 1 and the bung 3*a*. If a rubber bung is used it could have a spigot engaging in bung 3*a*. An attempt to remove bung 3*a* by pulling on the hemispherical bung would detach the two bungs without removing bung 3*a*.

In FIG. 1, it is alternatively possible to replace the ceramic tube by a mica tube reinforced on its outer surface by glass fiber. This tube may comprise an inner wrap of epoxy bonded "Filamic" material and an outer wrap of woven glass fiber, also epoxy bonded. The "Filamic" material is a mica material bonded with synthetic resin and provides a relatively high beat resistance whilst the glass fiber surrounding the mica material is provided of sufficient thickness to give the resulting tube adequate mechanical strength to meet British Standards No. 3456.

In a development of this embodiment, the mica tube may be coaxial with, and substantially coextensive axially with, a metal tube also telescoped to the plastic tube at one end and closed at its other by, e.g., bung 3*a*.

Figure 2:
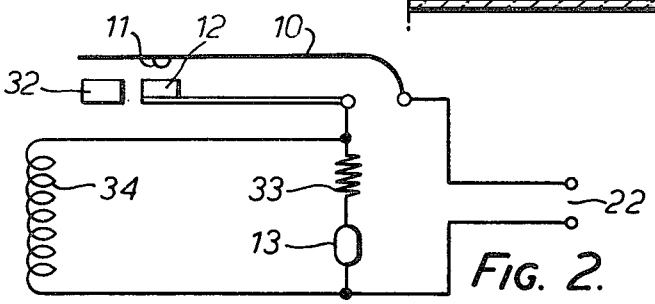
FIG. 2 shows a circuit of the heater.

FIG. 2 shows the circuit of the heater of FIG. 1. Heater conductor 34 is connected across input cable 22 by a bimetallic strip 10, having a contact 11 and a counter-contact 12. A magnet 32 biases the strip 10. A neon 13, with a ballast resistor 33, is provided to indicate when the voltage is applied to the heater conductor 34. The neon, when illuminated, is visible through the plastic tube 2.

I claim:

1. An electrical heater for heating a liquid, the heater having: an electrical heating element; a temperature-sensitive device for controlling the operating temperature of the element as a function of ambient temperature; a tubular enclosure sealed against ingress of moisture and formed by a first tube closed at one end, an electrically insulating second tube joined at one end in water-tight manner to the other end of the first tube and a sealing member sealing the other end of the second tube, the heating element being within the first tube and the temperature-sensitive device being within the second tube, the first tube being electrically insulating, water-impermeable, capable of withstanding the heat transmitted through it from the heating element and capable of withstanding an impact with an energy of 0.5 Nm applied by a hammer having a tip of 10 mm radius; and power supply conductor arrangement a portion of which passes through the sealing member in water-tight manner and is connected to said temperature-sensitive device and a portion of which, within the enclosure, passes from the second to the first tube and couples the heating element and the temperature-sensitive device.

2. A heater according to claim 1, wherein the first tube is of ceramic.

3. A heater according to claim 2, wherein the first tube is of aluminous porcelain.

4. A heater according to claim 1, wherein the first tube is of mica reinforced on its outer surface by glass fiber.

5. A heater according to claim 1, wherein a particulate mineral insulation substantially fills the space between the heating element and the first tube.

6. A heater according to claim 5 and comprising heat insulating material in the enclosure separating a first and a second zone, the first zone containing said heating element and the mineral insulation and the second zone containing the temperature-sensitive device and being wholly within the second tube.

7. A heater according to claim 6, wherein the heat insulating material comprises a bung through which conductors of said power supply arrangement pass, there being a sealing washer in said first zone to prevent the passage of mineral insulation through the bung.

8. A heater according to claim 1, wherein the tubular enclosure is contained in a glass tube having sealing means sealing the glass tube against ingress of water, the first tube being sufficiently strong to withstand said impact when transmitted via said glass tube.

9. A heater according to claim 2, wherein the first and second tubes are telescoped together at said other end of the first tube and are held by a pin engaging the first and second tubes in a press-fit manner.

10. A heater according to claim 9, wherein the enclosure is contained in a glass tube having sealing means sealing the glass tube against ingress of moisture.

* * * * *